US008099267B2

(12) United States Patent
Cox et al.

(10) Patent No.: US 8,099,267 B2
(45) Date of Patent: Jan. 17, 2012

(54) INPUT DECK MIGRATOR FOR SIMULATORS

(75) Inventors: Jonathan Cox, Witney (GB); Simon Bulman, Bicester (GB); Nigel Lester, Oxfordshire (GB); Jonathan Morris, Oxford (GB); Michael Talbot, Calgary (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 439 days.

(21) Appl. No.: 12/346,008

(22) Filed: Dec. 30, 2008

(65) Prior Publication Data

US 2009/0182540 A1 Jul. 16, 2009

Related U.S. Application Data

(60) Provisional application No. 61/020,674, filed on Jan. 11, 2008.

(51) Int. Cl.

| | |
|---|---|
| ***G06G 7/48*** | (2006.01) |
| ***G06F 19/00*** | (2011.01) |
| ***G01V 1/40*** | (2006.01) |
| ***G01V 3/18*** | (2006.01) |
| ***G01V 5/04*** | (2006.01) |
| ***G01V 9/00*** | (2006.01) |

(52) U.S. Cl. ..... 703/10; 703/6; 702/6

(58) Field of Classification Search ..... 703/6, 9, 703/10

See application file for complete search history.

(56) References Cited

U.S. PATENT DOCUMENTS

| | | | | |
|---|---|---|---|---|
| 4,964,103 | A | 10/1990 | Johnson | |
| 5,444,619 | A | 8/1995 | Hoskins et al. | |
| 5,992,519 | A | 11/1999 | Ramakrishnan et al. | |
| 6,106,561 | A * | 8/2000 | Farmer | 703/10 |
| 6,230,101 | B1 | 5/2001 | Wallis | |
| 6,313,837 | B1 | 11/2001 | Assa et al. | |
| 6,980,940 | B1 | 12/2005 | Gurpinar et al. | |
| 7,069,148 | B2 | 6/2006 | Thambynayagam et al. | |
| 7,164,990 | B2 | 1/2007 | Bratvedt et al. | |
| 7,248,259 | B2 | 7/2007 | Fremming et al. | |
| 7,561,997 | B1 * | 7/2009 | Miller | 703/10 |
| 7,809,544 | B1 * | 10/2010 | Trimberger | 703/15 |
| 2001/0042642 | A1 | 11/2001 | King | |
| 2003/0216897 | A1 | 11/2003 | Endres et al. | |
| 2004/0015295 | A1 * | 1/2004 | Bratvedt et al. | 702/13 |
| 2004/0015808 | A1 * | 1/2004 | Pang et al. | 716/19 |
| 2004/0220846 | A1 | 11/2004 | Cullick et al. | |
| 2005/0015231 | A1 * | 1/2005 | Edwards et al. | 703/10 |
| 2005/0149307 | A1 | 7/2005 | Gurpinar et al. | |
| 2005/0236184 | A1 | 10/2005 | Veeningen et al. | |
| 2006/0129366 | A1 | 6/2006 | Shaw | |
| 2006/0184329 | A1 | 8/2006 | Rowan et al. | |
| 2006/0197759 | A1 | 9/2006 | Fremming | |

(Continued)

FOREIGN PATENT DOCUMENTS

EP 1249743 A1 4/2001

(Continued)

*Primary Examiner* — Paul Rodriguez
*Assistant Examiner* — Cedric D Johnson

(57) ABSTRACT

An example method for performing an operation includes obtaining an input deck of a first simulator, the input deck being prepared based on field data for performing a simulation of the operation using the first simulator. The method further includes migrating the input deck from the first simulator to generate input for a second simulator, the second simulator being configured to simulate the operation based on the input to generate a simulation result. The method further includes storing the simulation result in a repository.

17 Claims, 9 Drawing Sheets

U.S. PATENT DOCUMENTS

| | | | | |
|---|---|---|---|---|
| 2006/0235811 | A1 | 10/2006 | Fairweather | |
| 2007/0061087 | A1 | 3/2007 | Ghorayeb et al. | |
| 2007/0112547 | A1 | 5/2007 | Ghorayeb et al. | |
| 2008/0103743 | A1* | 5/2008 | Howell et al. | 703/10 |
| 2008/0235280 | A1* | 9/2008 | Schoen et al. | 707/104.1 |
| 2008/0300793 | A1 | 12/2008 | Tilke et al. | |

FOREIGN PATENT DOCUMENTS

| | | | |
|---|---|---|---|
| WO | 99/52048 | | 10/1999 |
| WO | 99/64896 | A1 | 12/1999 |
| WO | 01/84189 | A1 | 11/2001 |
| WO | 2004/049216 | | 6/2004 |
| WO | 2006096812 | A2 | 9/2006 |

* cited by examiner

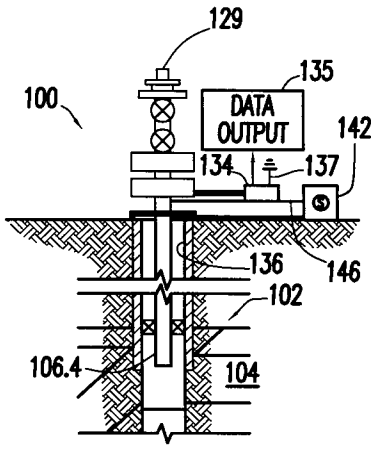
FIG. 1.1
FIG. 1.2
FIG. 1.3
FIG. 1.4
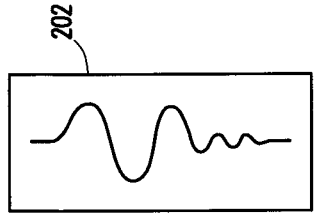
FIG. 2.1
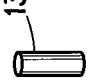
FIG. 2.2
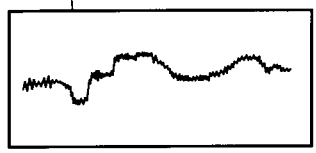
FIG. 2.3
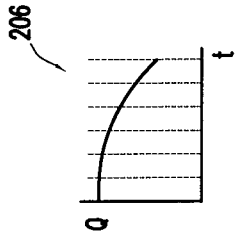
FIG. 2.4

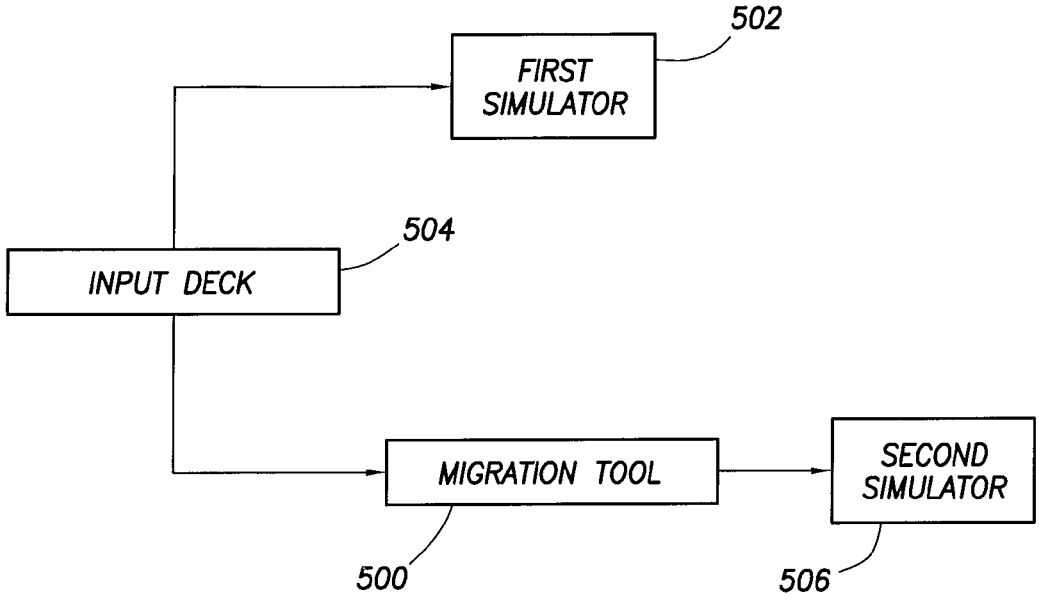
FIG.5.1
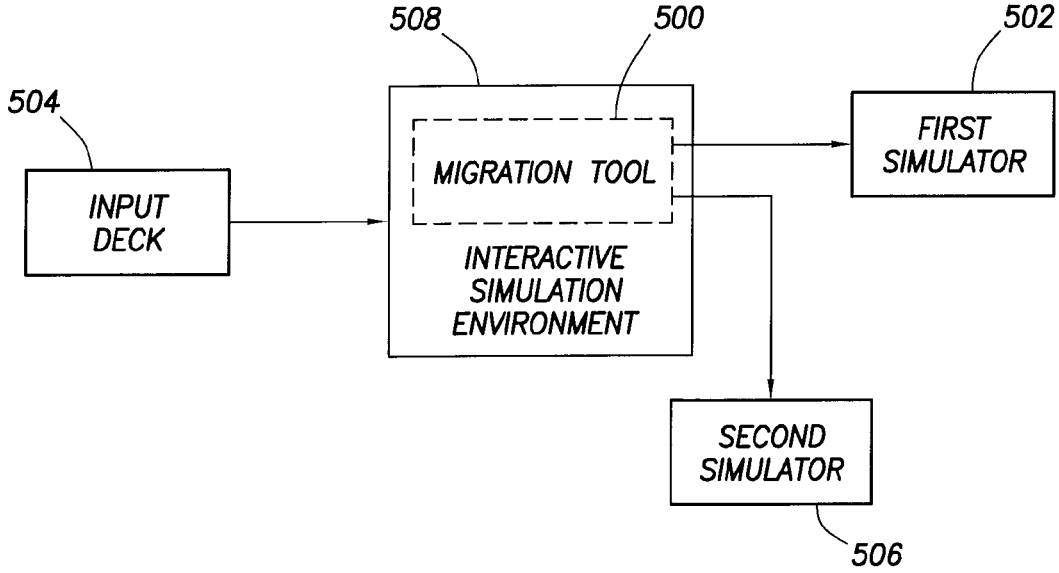
FIG.5.2

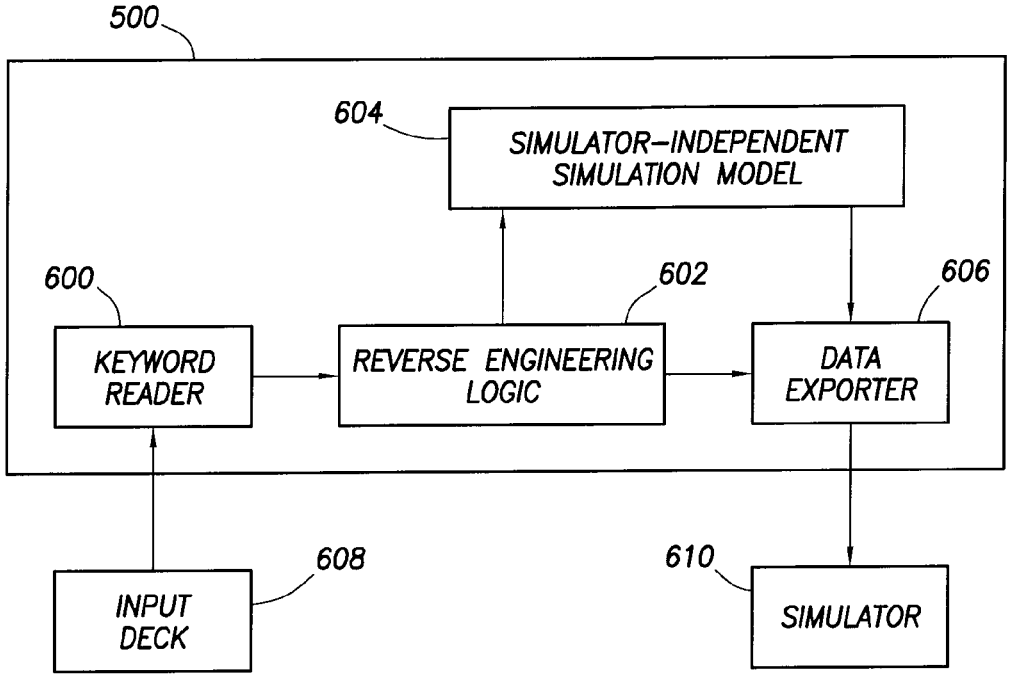
FIG.6.1
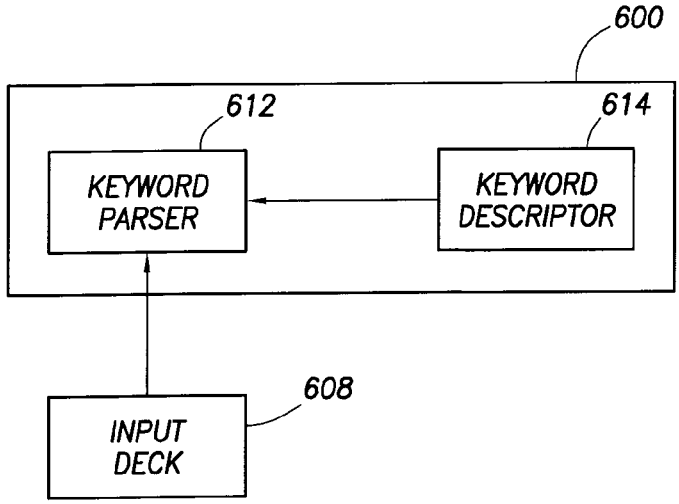
FIG.6.2

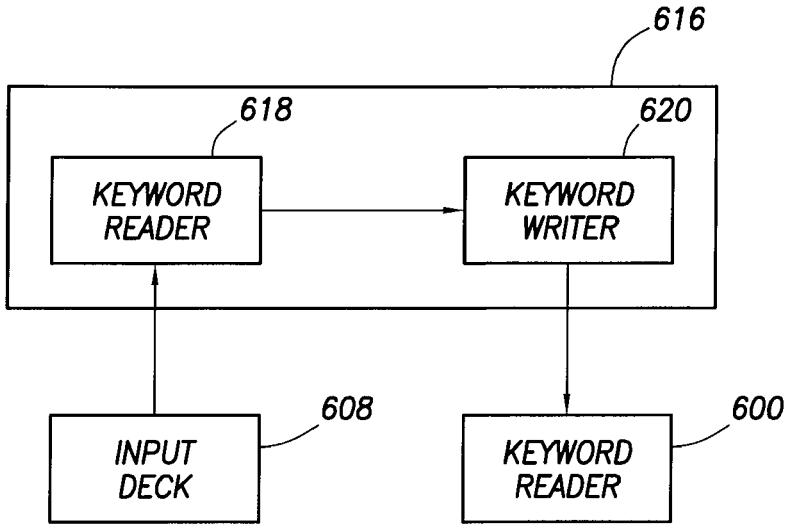
FIG.6.3
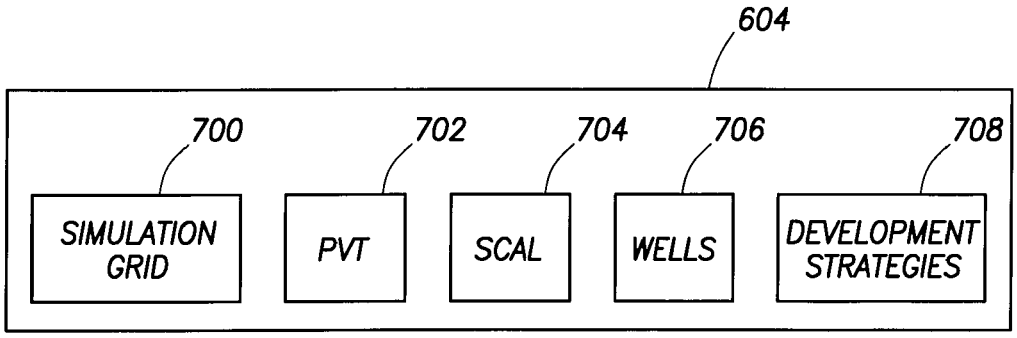
FIG.7

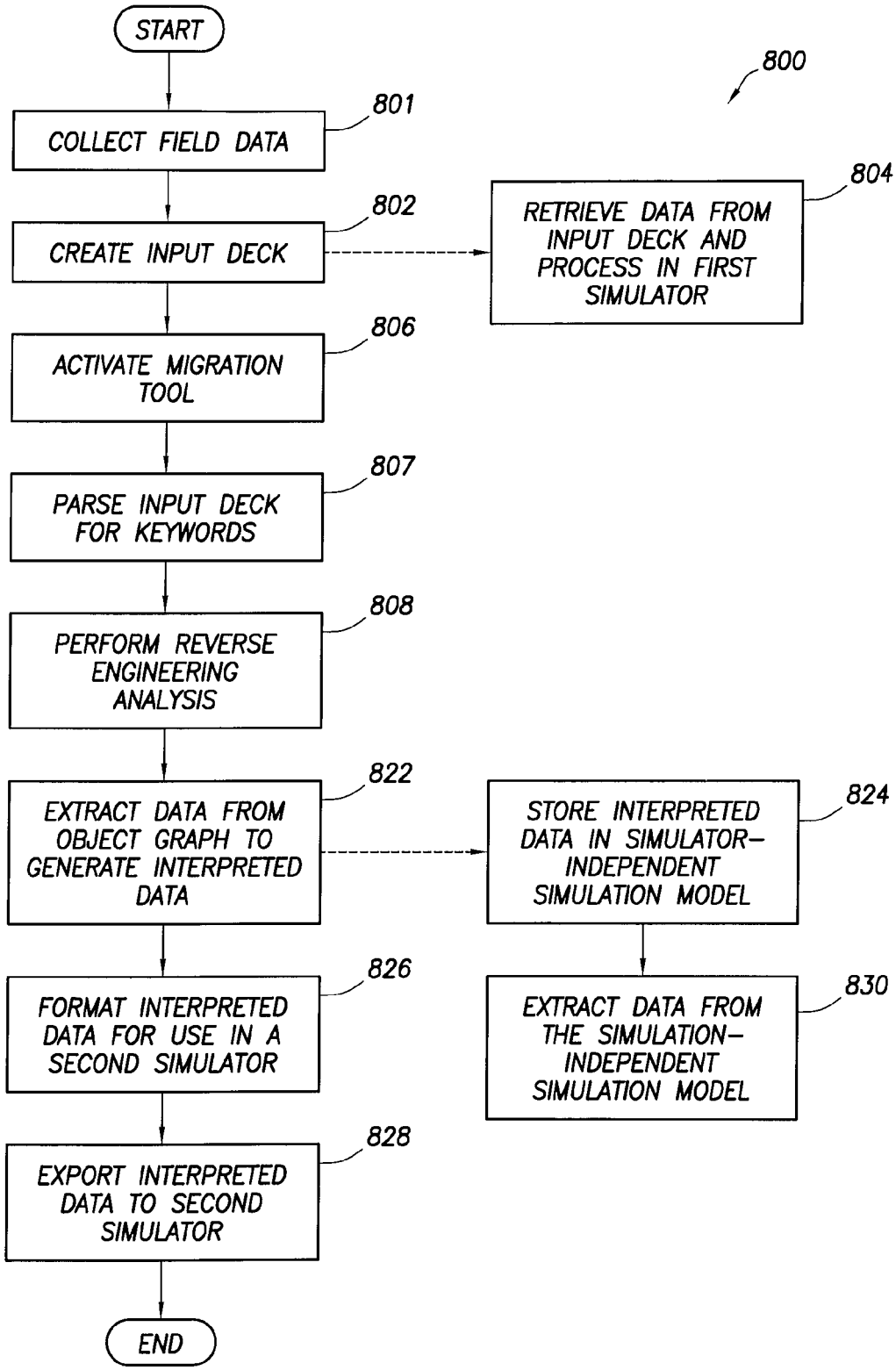
FIG.8.1

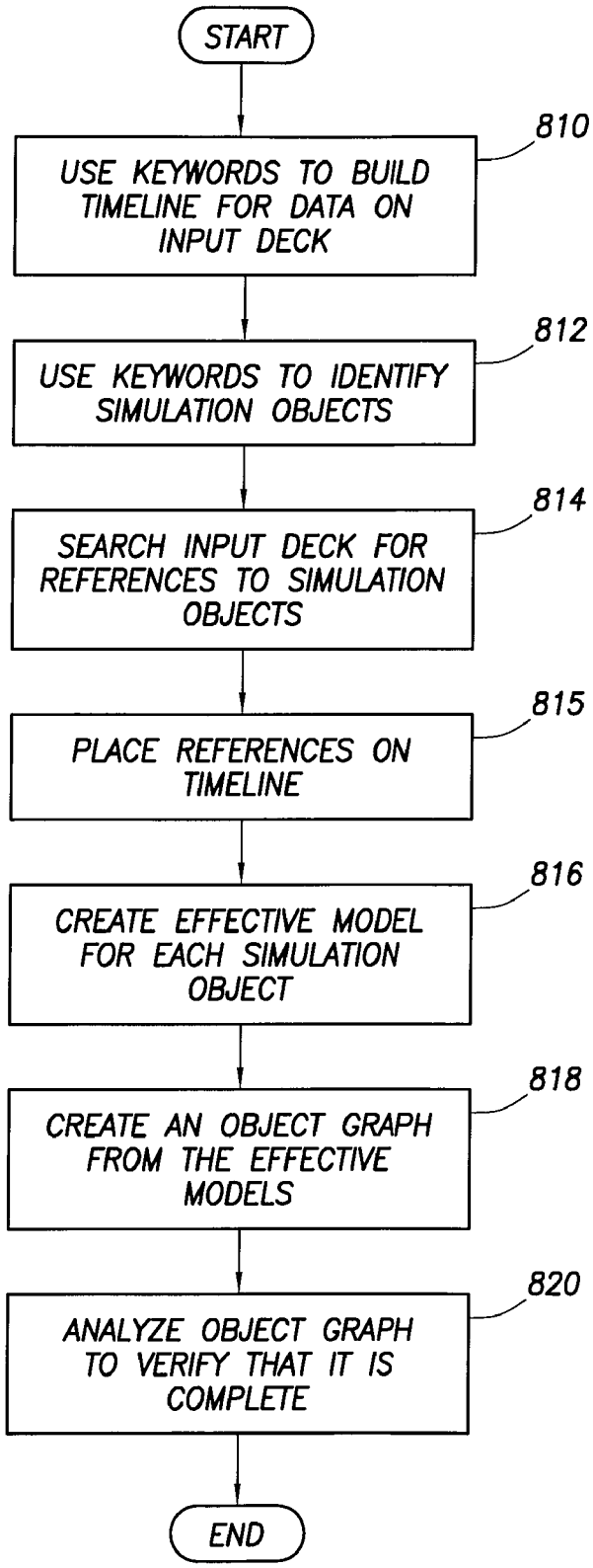
FIG.8.2

INPUT DECK MIGRATOR FOR SIMULATORS

CROSS REFERENCE TO RELATED APPLICATIONS

This application claims priority under 35 U.S.C. §119(e) from Provisional Patent Application No. 61/020,674 filed Jan. 11, 2008, entitled "System and Method for Performing Reservoir Operations for an Oilfield", which is hereby incorporated by reference in its entirety.

BACKGROUND

Operations, such as surveying, drilling, wireline testing, completions, production, planning and field analysis, are typically performed to locate and gather valuable downhole fluids. During the operations, data is typically collected for analysis and/or monitoring of the operations. Such data may include, for instance, subterranean formation, equipment, historical and/or other data. Such formation data may be static or dynamic. Static data relates to, for instance, formation structure and geological stratigraphy that define geological structures of the subterranean formation. Dynamic data relates to, for instance, fluids flowing through the geologic structures of the subterranean formation over time. Such static and/or dynamic data may be collected to learn more about the formations and the valuable assets contained therein.

Sensors may be positioned about the field to collect data relating to various operations. For instance, sensors in the drilling equipment may monitor drilling conditions, sensors in the wellbore may monitor fluid composition, sensors located along the flow path may monitor flow rates and sensors at the processing facility may monitor fluids collected. Other sensors may be provided to monitor downhole, surface, equipment or other conditions. Such conditions may relate to the type of equipment at the wellsite, the operating setup, formation parameters or other variables of the field. The monitored data is often used to make decisions at various locations of the field at various times. Data collected by these sensors may be further analyzed and processed. Data may be collected and used for current or future operations. When used for future operations at the same or other locations, such data may sometimes be referred to as historical data.

The data may be used to predict downhole conditions, and make decisions concerning operations. Such decisions may involve well planning, well targeting, well completions, operating levels, production rates and other operations and/or operating parameters. Often this information is used to determine when to drill new wells, re-complete existing wells or alter wellbore production. Field conditions, such as geological, geophysical, and reservoir engineering characteristics, may have an impact on operations, such as risk analysis, economic valuation, and mechanical considerations for the production of subsurface reservoirs. Data from one or more wellbores may be analyzed to plan or predict various outcomes at a given wellbore. In some cases, the data from neighboring wellbores, or wellbores with similar conditions or equipment, may be used to predict how a well will perform. There are usually a large number of variables and large quantities of data to consider in analyzing operations. It is, therefore, often useful to model the behavior of the operation to determine a desired course of action. During the ongoing operations, the operating parameters may be adjusted as field conditions change and new information is received.

Simulators for modeling aspects of a field receive field data as input and process the data to generate simulation results.

Typically, the input model and input language for the simulators are as varied as the number of simulators so that if a user wishes to use features of different simulators in a particular field analysis the user has to prepare an input model tailored for each simulator.

SUMMARY

An example method for performing an operation includes obtaining an input deck of a first simulator, the input deck being prepared based on field data for performing a simulation of the operation using the first simulator. The method further includes migrating the input deck from the first simulator to generate input for a second simulator, the second simulator being configured to simulate the operation based on the input to generate a simulation result. The method further includes storing the simulation result in a repository.

Other aspects of input deck migrators for simulators will be apparent from the following description and the appended claims.

BRIEF DESCRIPTION OF THE DRAWINGS

The accompanying drawings, described below, illustrate typical embodiments and are not to be considered limiting of its scope, for input deck migrators for simulators may admit to other equally effective embodiments. The figures are not necessarily to scale, and certain features and certain views of the figures may be shown exaggerated in scale or in schematic in the interest of clarity and conciseness.

FIG. 1.1 depicts a simplified, schematic view of an operation having subterranean formations containing reservoirs and a survey operation being performed by a seismic truck.

FIG. 1.2 depicts a simplified, schematic view of an operation having subterranean formations containing reservoirs and a drilling operation being performed by a drilling tool suspended by a rig and advanced into the subterranean formations.

FIG. 1.3 depicts a simplified, schematic view of an operation having subterranean formations containing reservoirs and a wireline operation being performed by a wireline tool suspended in a wellbore by a rig.

FIG. 1.4 depicts a simplified, schematic view of an operation having subterranean formations containing reservoirs and a production operation being performed by a production tool deployed from a production unit into a completed wellbore for drawing fluid from the reservoirs into surface facilities.

FIG. 2.1 depicts a seismic trace of the subterranean formation of FIG. 1.1.

FIG. 2.2 depicts a core test result of the core sample of FIG. 1.2.

FIG. 2.3 depicts a well log of the subterranean formation of FIG. 1.3.

FIG. 2.4 depicts a production decline curve of fluid flowing through the subterranean formation of FIG. 1.4.

FIG. 5.1 is a schematic view of a migrator in an environment of use in accordance with implementations of various techniques described herein.

FIG. 5.2 is a schematic view of the migrator of FIG. 5.1 in another environment of use in accordance with implementations of various techniques described herein.

FIG. 6.1 is a block diagram of the migrator of FIGS. 5.1 and 5.2 in accordance with implementations of various techniques described herein.

FIG. 6.2 is a block diagram of a keyword reader used in the migrator of FIG. 6.1 in accordance with implementations of various techniques described herein.

FIG. 6.3 is a block diagram of a keyword converter usable with the keyword reader shown in FIG. 6.2 in accordance with implementations of various techniques described herein.

FIG. 7 is a block diagram of a simulation-independent simulation model in accordance with implementations of various techniques described herein.

FIG. 8.1 is a flowchart illustrating a method of performing an operation in accordance with implementations of various techniques described herein.

FIG. 8.2 is a flowchart illustrating a reverse engineering operation included in the method of FIG. 8.1 in accordance with implementations of various techniques described herein.

DETAILED DESCRIPTION

Figure 3:
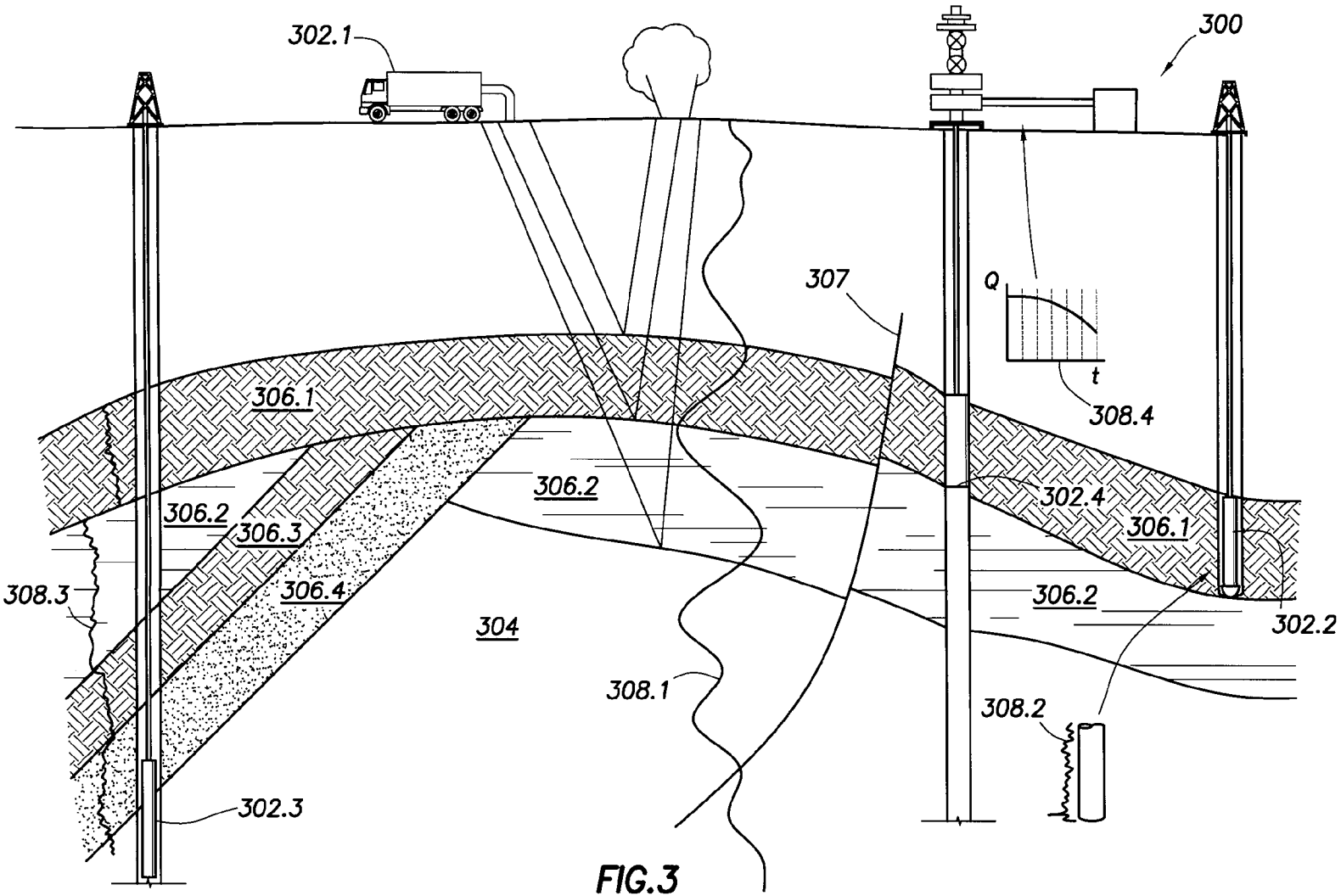
FIG. 3 is a schematic view, partially in cross-section, of a field having a plurality of data acquisition tools positioned at various locations along the field for collecting data from the subterranean formation.

The discussion below is directed to certain specific implementations. It is to be understood that the discussion below is for the purpose of enabling a person with ordinary skill in the art to make and use any subject matter defined now or later by the patent "claims" found in any issued patent herein.

Various techniques described herein are implemented with reference to an operation. As such, before describing implementations of these techniques, it may be useful to describe a suitable operation that may benefit from the various techniques described herein.

In one implementation, input deck migrators for simulators relate to techniques for performing operations relating to subterranean formations having reservoirs therein. More particularly, input deck migrators for simulators can relate to techniques for performing operations involving an analysis of reservoir and related field conditions, such as fluid composition, rock-fluid interaction and reservoir characteristics, and their impact on operations.

FIGS. 1.1-1.4 depict simplified, representative, schematic views of a field (100) having subterranean formation (102) containing reservoir (104) therein and depicting various operations being performed on the field. FIG. 1.1 depicts a survey operation being performed by a survey tool, such as seismic truck (106.1), to measure properties of the subterranean formation. The survey operation is a seismic survey operation for producing sound vibrations. In FIG. 1.1, one such sound vibration (112) generated by a source (110) reflects off a plurality of horizons (114) in an earth formation (116). The sound vibration(s) (112) is (are) received by sensors, such as geophone-receivers (118), situated on the earth's surface, and the geophones (118) produce electrical output signals, referred to as data received (120) in FIG. 1.1.

In response to the received sound vibration(s) (112) representative of different parameters (such as amplitude and/or frequency) of the sound vibration(s) (112), the geophones (118) produce electrical output signals containing data concerning the subterranean formation. The data received (120) is provided as input data to a computer (122.1) of the seismic truck (106.1), and responsive to the input data, the computer (122.1) generates a seismic data output (124). The seismic data output may be stored, transmitted or further processed as desired, for instance by data reduction.

FIG. 1.2 depicts a drilling operation being performed by a drilling tool (106.2) suspended by a rig (128) and advanced into the subterranean formations (102) to form a wellbore (136). A mud pit (130) is used to draw drilling mud into the drilling tools via flow line (132) for circulating drilling mud through the drilling tools, up the wellbore (136) and back to the surface. The drilling mud is usually filtered and returned to the mud pit. A circulating system may be used for storing, controlling or filtering the flowing drilling muds. The drilling tools are advanced into the subterranean formations to reach reservoir (104). Each well may target one or more reservoirs. The drilling tools may be adapted for measuring downhole properties using logging while drilling tools. The logging while drilling tool may also be adapted for taking a core sample (133) as shown, or removed so that a core sample may be taken using another tool.

A surface unit (134) is used to communicate with the drilling tools and/or offsite operations. The surface unit (134) is capable of communicating with the drilling tools to send commands to the drilling tools, and to receive data therefrom. The surface unit (134) may be provided with computer facilities for receiving, storing, processing, and/or analyzing data from the field. The surface unit (134) collects data generated during the drilling operation and produces data output (135) which may be stored or transmitted. Computer facilities, such as those of the surface unit (134), may be positioned at various locations about the field and/or at remote locations.

Sensors (S), such as gauges, may be positioned about the field to collect data relating to various operations as described previously. As shown, the sensor (S) is positioned in one or more locations in the drilling tools and/or at the rig to measure drilling parameters, such as weight on bit, torque on bit, pressures, temperatures, flow rates, compositions, rotary speed and/or other parameters of the operation. Sensors (S) may also be positioned in one or more locations in the circulating system.

The data gathered by the sensors (S) may be collected by the surface unit and/or other data collection sources for analysis or other processing. The data collected by the sensors (S) may be used alone or in combination with other data. The data may be collected in one or more databases and/or transmitted on or offsite. All or select portions of the data may be selectively used for analyzing and/or predicting operations of the current and/or other wellbores. The data may be may be historical data, real time data or combinations thereof. The real time data may be used in real time, or stored for later use. The data may also be combined with historical data or other inputs for further analysis. The data may be stored in separate databases, or combined into a single database.

The collected data may be used to perform analysis, such as modeling operations. For instance, the seismic data output may be used to perform geological, geophysical, and/or reservoir engineering. The reservoir, wellbore, surface and/or process data may be used to perform reservoir, wellbore, geological, geophysical, or other simulations. The data outputs from the operation may be generated directly from the sensors (S), or after some preprocessing or modeling. These data outputs may act as inputs for further analysis.

The data may be collected and stored at the surface unit (134). One or more surface units may be located at the field, or connected remotely thereto. The surface unit (134) may be a single unit, or a complex network of units used to perform the necessary data management functions throughout the field. The surface unit (134) may be a manual or automatic system. The surface unit may be operated and/or adjusted by a user.

The surface unit may be provided with a transceiver (137) to allow communications between the surface unit (134) and various portions of the field or other locations. The surface unit (134) may also be provided with or functionally connected to one or more controllers for actuating mechanisms at the field. The surface unit (134) may then send command signals to the field in response to data received. The surface unit (134) may receive commands via the transceiver or may itself execute commands to the controller. A processor may be provided to analyze the data (locally or remotely), make the decisions and/or actuate the controller. In this manner, the field may be selectively adjusted based on the data collected. This technique may be used to optimize portions of the operation, such as controlling drilling, weight on bit, pump rates or other parameters. These adjustments may be made automatically based on computer protocol, and/or manually by an operator. In some cases, well plans may be adjusted to select optimum operating conditions, or to avoid problems.

FIG. 1.3 depicts a wireline operation being performed by a wireline tool (106.3) suspended by the rig (128) and into the wellbore (136) of FIG. 1.2. The wireline tool (106.3) may be adapted for deployment into a wellbore for generating well logs, performing downhole tests and/or collecting samples. The wireline tool (106.3) may be used to provide another method and apparatus for performing a seismic survey operation. The wireline tool (106.3) of FIG. 1.3 may, for instance, have an explosive, radioactive, electrical, or acoustic energy source (144) that sends and/or receives electrical signals to the surrounding subterranean formations (102) and fluids therein.

The wireline tool (106.3) may be operatively connected to, for instance, the geophones (118) and the computer (122.1) of the seismic truck (106.1) of FIG. 1.1. The wireline tool (106.3) may also provide data to the surface unit (134). The surface unit (134) collects data generated during the wireline operation and produces data output (135) which may be stored or transmitted. The wireline tool (106.3) may be positioned at various depths in the wellbore to provide a survey or other information relating to the subterranean formation.

Sensors (S), such as gauges, may be positioned about the field to collect data relating to various operations as described previously. As shown, the sensor (S) is positioned in the wireline tool (134) to measure downhole parameters which relate to, for instance porosity, permeability, fluid composition and/or other parameters of the operation.

FIG. 1.4 depicts a production operation being performed by a production tool (106.4) deployed from a production unit or Christmas tree (129) and into the completed wellbore (136) of FIG. 1.3 for drawing fluid from the downhole reservoirs into surface facilities (142). Fluid flows from reservoir (104) through perforations in the casing (not shown) and into the production tool (106.4) in the wellbore (136) and to the surface facilities (142) via a gathering network (146).

Sensors (S), such as gauges, may be positioned about the field to collect data relating to various operations as described previously. As shown, the sensor (S) may be positioned in the production tool (106.4) or associated equipment, such as the Christmas tree, gathering network, surface facilities and/or the production facility, to measure fluid parameters, such as fluid composition, flow rates, pressures, temperatures, and/or other parameters of the production operation.

While simplified wellsite configurations are shown, it will be appreciated that the field may cover a portion of land, sea and/or water locations that hosts one or more wellsites. Production may also include injection wells (not shown) for added recovery. One or more gathering facilities may be operatively connected to one or more of the wellsites for selectively collecting downhole fluids from the wellsite(s).

While FIG. 1.2-1.4 depict tools used to measure properties of a field, it will be appreciated that the tools may be used in connection with non-operations, such as mines, aquifers, storage or other subterranean facilities. Also, while certain data acquisition tools are depicted, it will be appreciated that various measurement tools capable of sensing parameters, such as seismic two-way travel time, density, resistivity, production rate, etc., of the subterranean formation and/or its geological formations may be used. Various sensors (S) may be located at various positions along the wellbore and/or the monitoring tools to collect and/or monitor the desired data. Other sources of data may also be provided from offsite locations.

The field configuration of FIGS. 1.1-1.4 is intended to provide a brief description of an example of a field usable with input deck migrators for simulators. Part, or all, of the field may be on land, water and/or sea. Also, while a single field measured at a single location is depicted, input deck migrators for simulators may be utilized with any combination of one or more fields, one or more processing facilities and one or more wellsites.

FIGS. 2.1-2.4 are graphical depictions of examples of data collected by the tools of FIGS. 1.1-1.4, respectively. FIG. 2.1 depicts a seismic trace (202) of the subterranean formation of FIG. 1.1 taken by seismic truck 106.1. The seismic trace may be used to provide data, such as a two-way response over a period of time. FIG. 2.2 depicts a core sample (133) taken by the drilling tools (106.2). The core sample (133) may be used to provide data, such as a graph of the density, porosity, permeability or other physical property of the core sample (133) over the length of the core. Tests for density and viscosity may be performed on the fluids in the core at varying pressures and temperatures. FIG. 2.3 depicts a well log (204) of the subterranean formation of FIG. 1.3 taken by the wireline tool (106.3). The wireline log typically provides a resistivity or other measurement of the formation at various depts. FIG. 2.4 depicts a production decline curve or graph (206) of fluid flowing through the subterranean formation of FIG. 1.4 measured at the surface facilities (142). The production decline curve typically provides the production rate Q as a function of time t.

The respective graphs of FIG. 2.1-2.3 depict examples of static measurements that may describe or provide information about the physical characteristics of the formation and reservoirs contained therein. These measurements may be analyzed to better define the properties of the formation(s) and/or determine the accuracy of the measurements and/or for checking for errors. The plots of each of the respective measurements may be aligned and scaled for comparison and verification of the properties.

FIG. 2.4 depicts an example of a dynamic measurement of the fluid properties through the wellbore. As the fluid flows through the wellbore, measurements are taken of fluid properties, such as flow rates, pressures, composition, etc. As described below, the static and dynamic measurements may be analyzed and used to generate models of the subterranean formation to determine characteristics thereof. Similar measurements may also be used to measure changes in formation aspects over time.

FIG. 3 is a schematic view, partially in cross section of a field (300) having data acquisition tools (302.1, 302.2, 302.3 and 302.4) positioned at various locations along the field for collecting data of the subterranean formation (304). The data acquisition tools (302.1-302.4) may be the same as data acquisition tools (106.1-106.4) of FIGS. 1.1-1.4, respectively, or others not depicted. As shown, the data acquisition tools (302.1-0.302.4) generate data plots or measurements (308.1-0.308.4), respectively. These data plots are depicted along the field to demonstrate the data generated by the various operations.

Data plots (308.1-0.308.3) are examples of static data plots that may be generated by the data acquisition tools (302.1-0.302.3), respectively. Static data plot (308.1) is a seismic two-way response time and may be the same as the seismic trace (202) of FIG. 2.1. Static plot (308.2) is core sample data measured from a core sample of the formation (304), similar to core sample (133) of FIG. 2.2. Static data plot (308.3) is a logging trace, similar to the well log (204) of FIG. 2.3. Production decline curve or graph (308.4) is a dynamic data plot of the fluid flow rate over time, similar to the graph (206) of FIG. 2.4. Other data may also be collected, such as historical data, user inputs, economic information and/or other measurement data and other parameters of interest.

The subterranean structure (304) has a plurality of geological formations (306.0-306.4). As shown, the structure has several formations or layers, including a shale layer (306.1), a carbonate layer (306.2), a shale layer (306.3) and a sand layer (306.4). A fault (307) extends through the layers (306.1), (306.2). The static data acquisition tools are adapted to take measurements and detect characteristics of the formations.

While a specific subterranean formation with specific geological structures is depicted, it will be appreciated that the field may contain a variety of geological structures and/or formations, sometimes having extreme complexity. In some locations, typically below the water line, fluid may occupy pore spaces of the formations. Each of the measurement devices may be used to measure properties of the formations and/or its geological features. While each acquisition tool is shown as being in specific locations in the field, it will be appreciated that one or more types of measurement may be taken at one or more location across one or more fields or other locations for comparison and/or analysis.

The data collected from various sources, such as the data acquisition tools of FIG. 3, may then be processed and/or evaluated. Typically, seismic data displayed in the static data plot (308.1) from the data acquisition tool (302.1) is used by a geophysicist to determine characteristics of the subterranean formations and features. Core data shown in static plot (308.2) and/or log data from the well log (308.3) are typically used by a geologist to determine various characteristics of the subterranean formation. Production data from the graph (308.4) is typically used by the reservoir engineer to determine fluid flow reservoir characteristics. The data analyzed by the geologist, geophysicist and the reservoir engineer may be analyzed using modeling techniques.

Figure 4:
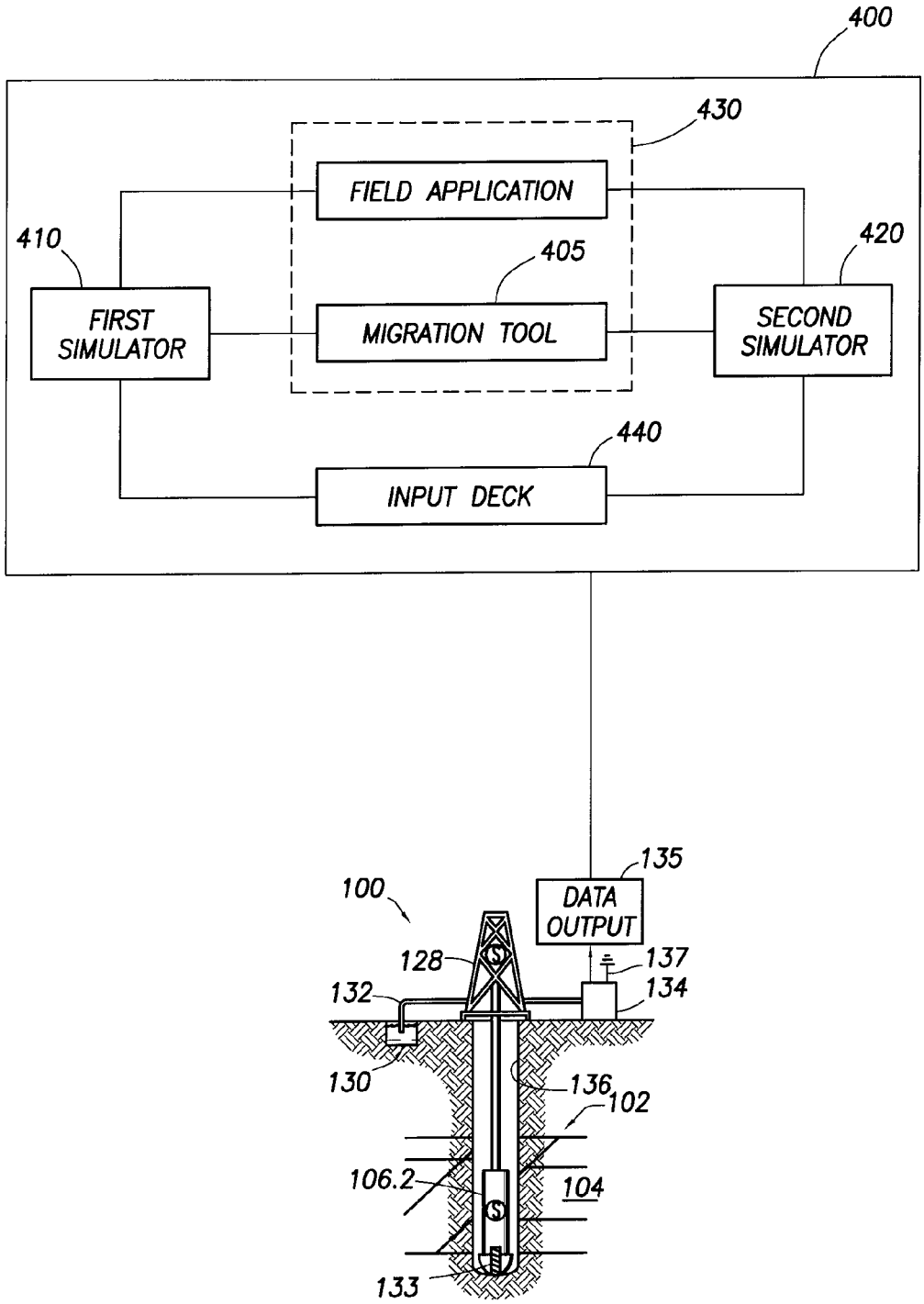
FIG. 4 illustrates a computing system into which implementations of various techniques described herein may be implemented in accordance with one or more embodiments.

FIG. 4 illustrates a reservoir system (400) in which various techniques described herein may be implemented. The reservoir system (400) may be coupled to the surface unit (134) or may be located at a data center remote from the survey region. The surface unit (134) and other portion of the field (100) described with respect to FIG. 1.2 is also included in FIG. 4 for illustration. So that the focus of the reservoir system (400) is not obscured, the description of the field (100) is not repeated here. The reservoir system (400) may include one or more system computers, which may be implemented as any conventional personal computer or server. However, those skilled in the art will appreciate that implementations of various technologies described herein may be practiced in other computer system configurations, including hypertext transfer protocol (HTTP) servers, hand-held devices, multiprocessor systems, microprocessor-based or programmable consumer electronics, network PCs, cluster systems, minicomputers, mainframe computers, and the like.

In one implementation, the reservoir system (400) may include a migrator (405) in communication with first simulator (410) and second simulator (420). First simulator (410) and second simulator (420) may be in communication with a field application (430), which may be used for performing an operation based on simulation results of the first simulator (410) and the second simulator (420). First simulator (410) and second simulator (420) may also be in communication with an input deck (440). The input deck (440) will be described in detail in the paragraphs below. The migrator (405), first simulator (410), second simulator (420) and the field application (430) include program instructions for performing various techniques described herein and will be described in more detail in the paragraphs below.

The program instructions may be written in a computer programming language, such as C++, Java, and the like. The migrator (405), first simulator (410), second simulator (420), field application (430) and input deck (440) may be stored in memory (not shown), which may be any computer-readable media and may include volatile, non-volatile, removable, and non-removable media implemented in any method or technology for storage of information, such as computer-readable instructions, data structures, program modules or other data. Computer storage media may further include RAM, ROM, erasable programmable read-only memory (EEPROM), flash memory or other solid state memory technology, CD-ROM, digital versatile disks (DV.4), or other optical storage, magnetic cassettes, magnetic tape, magnetic disk storage or other magnetic storage devices, or any other medium which can be used to store the desired information and which can be accessed by the processor (not shown). Combinations of any of the above may also be included within the scope of computer readable media. Furthermore, simulation results of the first simulator (410) and the second simulator (420) may be displayed using a display monitor (not shown) or stored in a repository (not shown), which may be part of the computer storage media described above.

FIG. 5.1 illustrates an environment in which a migrator (500) may be implemented in accordance with various techniques described herein. The migrator (500) may be communicatively coupled to an input deck (504) and a second simulator (506). The input deck (504) may be communicatively coupled to a first simulator (502).

The migrator (500) may be configured to facilitate reusability of the input deck (504) between the first and second simulators (502, 506). The input deck (504) may include a set of keywords describing a simulation model. Associated with the keywords are data or references to data used by the keywords to completely describe the simulation model. For simulation of operations, the input deck (504) may include field data, such as structural data for one or more reservoirs, pressure, volume, and temperature data for one or more reservoirs, geometry and completions data for one or more wells drilled through the subsurface, and other data used for reservoir modeling. The input deck (504) may be provided as a set of text files and/or a set of binary files stored in computer memory (not shown) or any other suitable computer-readable media. As such, the input deck (504) may be stored in memory (not shown) accessible by the processor (not shown) of the reservoir system (400). In one implementation, the input deck (504) may be tailored for use in the first simulator (502).

The first and second simulators (502), (506) are applications adapted for modeling subsurface structures and operations. The migrator (500) may operate as a standalone application or may be made of distributed components.

When the migrator (500) is activated, the migrator (500) may retrieve data from the input deck (504) and prepares the data for use with the second simulator (506). The migrator (500) allows the input deck (504), which may be tailored for use with the first simulator (502), to be reused with the second simulator (506) without modification. In this manner, a user can develop a single input deck and reuse that single input deck in more than one simulator, with the migrator (500) serving as an adaptive interface between the input deck and the simulators.

FIG. 5.2 illustrates another environment in which the migrator may be used in accordance with implementations of various techniques described herein. Here, the migrator (500) is provided as a component of an interactive simulation environment (508). The interactive simulation environment (508) may include an environment that allows a user to interact with the data in the interactive simulation environment (508). The interactive simulation environment (508) may be communicatively coupled to the input deck (504) so as to receive data from the input deck (504). The migrator (500) serves as an adaptive interface between the interactive simulation environment (508), the first simulator (502) and the second simulator (506). The user can interact with the data on the input deck (504) through the environment provided by the interactive simulation environment (508) prior to the migrator (500) preparing the data for use with the first and second simulators (502, 506).

FIG. 6.1 illustrates an example structure of the migrator (500) in accordance with implementations of various techniques described herein. The migrator (500) may include a keyword reader (600), a reverse engineering logic (602), a simulator-independent simulation model (604), and a data exporter (606). The keyword reader (600) may be communicatively coupled to an input deck (608). The data exporter (606) may be communicatively coupled to an input interface of a simulator (610).

FIG. 6.2 is a block diagram of a keyword reader (600) used in the migrator (500) in accordance with implementations of various techniques described herein. The keyword reader (600) may include a keyword parser (612) and a keyword descriptor (614). The keyword descriptor (614) contains a complete description of input keywords usable in the simulation-independent simulation model (604 in FIG. 6.1). The keyword descriptor (614) may be in the form of a structured file, such as an XML file, or other computer-readable structured format.

Using the input keyword descriptor (614) as a guide, the keyword parser (612) may parse the input deck (608) for a set of keywords. The keyword reader (600) may perform certain low-level analysis on the parsed keywords, such as layered sorting of the parsed keywords based on selected criteria, such as time and file type or structure.

In some implementations, the keyword syntax used in the input deck (608) may be inconsistent with the one used in the keyword descriptor (614). Where the keyword syntax used in the input deck (608) is inconsistent with the one used in the keyword descriptor (614), the keyword reader (600) may be preceded by a keyword converter. FIG. 6.3 illustrates an environment in which the keyword reader (600) may be preceded by a keyword converter (616). The keyword converter (616) may include a second keyword reader (618) having an internal keyword parser (not shown) and an internal keyword descriptor (not shown) using a keyword syntax that is consistent with that of the input deck (608). The keyword reader (618) parses the keywords on the input deck (608). Then, a keyword writer (620) takes the parsed keywords as input and generates a new set of keywords in a syntax that is understandable by the keyword reader (600). Keyword reader (600) may then operate on the new set of keywords as previously explained with respect to FIG. 6.2.

Referring again to FIG. 6.1, the reverse engineering logic (602) may be configured to decipher the simulation model described in the input deck (608) by analyzing the keywords parsed by the keyword reader (600). In other words, the reverse engineering logic (602) may be configured to decipher the intent of the user in constructing the input deck (608). The reverse engineering logic (602) may (i) analyze the keywords to build a timeline for the data on the input deck (608), (ii) analyze the keywords for simulation objects, such as rock, fluid, well data, and other objects related to simulation of the operation, (iii) search the input deck (608) for references to the simulation objects and place the references on the timeline, (iv) create an effective model for each simulation object, (v) use the effective models to build an object graph and (vi) extract data from the object graph and use the data to populate the simulation-independent simulation model (604). The operation of the reverse engineering logic (602) is described in more detail with reference to FIG. 8.2.

The data exporter (606) may be configured to extract data from the simulation-independent simulation model (604) to generate interpreted data. Alternatively, the data exporter (606) may extract data directly from the object graph to generate the interpreted data. The data exporter (606) may format the interpreted data for use in a simulator, such as simulator (610). The data exporter (606) may also export the formatted data to simulator (610) or otherwise make the data available for access by simulator (610).

The simulation-independent simulation model (604) is made up of components reflecting various parts of a simulator. In one implementation, the simulation-independent simulation model (604) is modular in its construction and can include a wide variety of simulation models to support data migration to a wide variety of simulators. For instance, as illustrated in FIG. 7, the simulation-independent simulation model (604) may include a simulation grid component (700), a pressure-volume-temperature component (702), a special core analysis component (704), a wells component (706), and a development strategy component (708). The simulation grid component (700) models reservoir structure data. The pressure-volume-temperature (PVT) component (702) models fluid data. The special core analysis (SCAL) component (704) models rock data. The wells component (706) models time-varying well-related data. The development strategies component (708) models field development decisions. In at least one example, the development strategies component (708) includes well and group specification data and development strategy rules arranged in a timeline.

The components of the simulation-independent simulation model (604) may be represented as objects that can be stored in a relational database. This would facilitate management of the simulation-independent simulation model (604). For instance, the database of objects can support queries to enumerate simulation models of a certain type. In one implementation, the simulation-independent simulation model (604) contains an in-memory representation of the objects inside the simulation. When the simulation-independent simulation model (604) is linked up to live access facilities of a simulator, the simulation-independent simulation model (604) can offer live access to the objects within the simulation-independent simulation model (604), thereby enabling run-time query and modification. The simulation-independent simulation model (604) may be situated in a user environment or may be directly bound to a simulator. Where the simulation-independent simulation model (604) is directly bound to a simulator, simulation logic may be shared between the simulation-independent simulation model (604) and the simulator.

While specific components are depicted and/or described for use in the units and/or modules of the migrator (500), it will be appreciated that a variety of components with various functions may be used to provide the formatting, processing, utility and coordination functions necessary to provide input deck migration in the migrator (500). The components may have combined functionalities and may be implemented as software, hardware, firmware, or combinations thereof.

FIG. 8.1 is a flowchart illustrating a method (800) of performing an operation on a field containing a subterranean formation with geological structures and reservoirs using the above referenced migrator in accordance with implementations of various techniques described herein. It should be understood that the operations illustrated in the flow diagram are not limited to being performed by the method (800). Additionally, it should be understood that while the operational flow diagram indicates a particular order of execution of the method, in some implementations, certain portions of the method might be executed in a different order.

At element 801, field data may be collected. The field data may be collected from various sources, such as seismic data, well logs, and production history. The field data may be historical, actual, or real-time. The field data may be collected directly or indirectly. At element 802, an input deck for a first simulator may be created from the field data. As mentioned above, the input deck may include a set of keywords and related data for a simulation model.

At element 804, the field data may be retrieved from the input deck and processed in the first simulator to generate simulation results. In one implementation, this element is an optional element. The simulation results may be used within the first simulator or simply passed on to another simulator or application for further processing and analysis.

To allow the input deck to be reused in a second simulator, a migrator as described above may be activated (element 806). Once the migrator is activated, the keyword parser of the migrator parses the input deck for a set of keywords (element 807). The keyword parser may perform a low-level analysis of the parsed keywords, such as creating multiple views of the keywords using selected criteria such as time or file structure.

After parsing the keywords, a reverse engineering operation may be performed to decipher the simulation model described by the field data on the input deck (element 808). The reverse engineering operation is described in more detail with reference to FIG. 8.2.

Referring now to FIG. 8.2, at element 810, a timeline for the data on the input deck may be built using the parsed keywords. At element 812, simulation objects, such as rock data, fluid data, well data and development strategies, on the input deck may be identified using the parsed keywords. At element 814, a search on the input deck may be performed for references to the simulation objects. At element 815, the references to the simulation objects may be placed along the timeline built in element 810. At element 816, an effective model for each simulation object may be created based on the references placed along the timeline. At element 818, an object graph of the effective models of the simulation objects may be created. The object graph may provide a system view of the simulation model at any particular time on the timeline. At element 820, the object graph may be analyzed to verify that it is complete.

Returning to FIG. 8.1, at element 822, field data from the object graph may be extracted to generate interpreted data. At element 824, the interpreted data may be stored in a simulator-independent simulation model. In one implementation, this element may be an optional element. At element 826, the interpreted data may be formatted for use in a second simulator. At element 828, the interpreted data may be transferred to the second simulator. At element 830, the interpreted data may also be extracted from the simulator-independent model. For instance, the interpreted data may be extracted for use in a simulator in real-time.

The method in FIGS. 8.1 and 8.2 are depicted in a specific order. However, it will be appreciated that portions of the method may be performed simultaneously or in a different order or sequence. The portions of the method may have combined functionalities and may be implemented as software, hardware, firmware, or combinations thereof.

Figure 9:
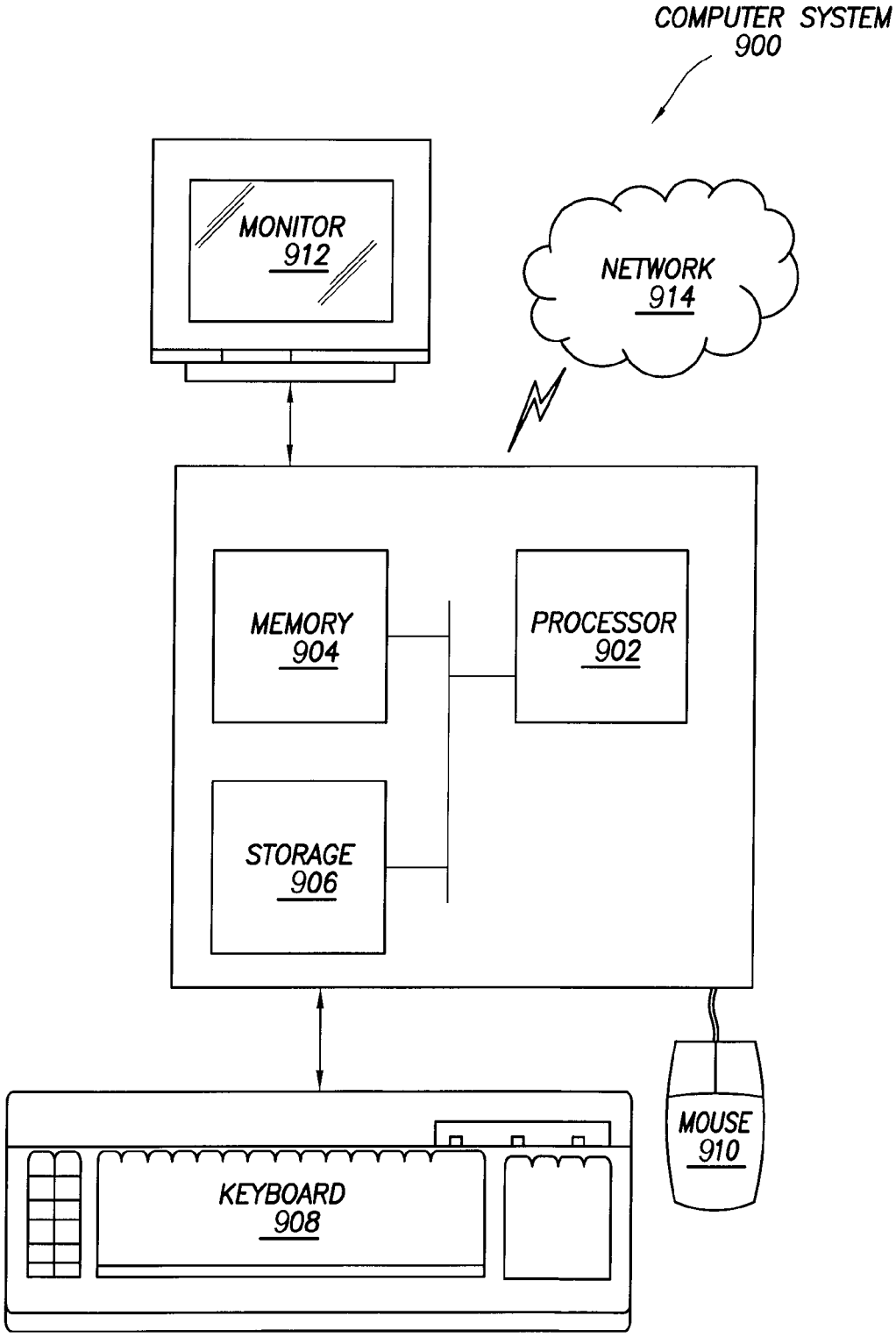
FIG. 9 shows a computer system in accordance with one or more embodiments of the invention.

Input deck migrator for simulators (or portions thereof), may be implemented on virtually any type of computer regardless of the platform being used. For example, as shown in FIG. 9, a computer system (900) includes one or more processor(s) (902), associated memory (904) (e.g., random access memory (RAM), cache memory, flash memory, etc.), a storage device (906) (e.g., a hard disk, an optical drive such as a compact disk drive or digital video disk (DVD) drive, a flash memory stick, etc.), and numerous other elements and functionalities typical of today's computers (not shown). The computer system (900) may also include input means, such as a keyboard (908), a mouse (910), or a microphone (not shown). Further, the computer system (900) may include output means, such as a monitor (912) (e.g., a liquid crystal display (LCD), a plasma display, or cathode ray tube (CRT) monitor). The computer system (900) may be connected to a network (914) (e.g., a local area network (LAN), a wide area network (WAN) such as the Internet, or any other similar type of network) with wired and/or wireless segments via a network interface connection (not shown). Those skilled in the art will appreciate that many different types of computer systems exist, and the aforementioned input and output means may take other forms. Generally speaking, the computer system (900) includes at least the minimal processing, input, and/or output means necessary to practice one or more embodiments.

Further, those skilled in the art will appreciate that one or more elements of the aforementioned computer system (900) may be located at a remote location and connected to the other elements over a network. Further, one or more embodiments may be implemented on a distributed system having a plurality of nodes, where each portion may be located on a different node within the distributed system. In one or more embodiments, the node corresponds to a computer system. Alternatively, the node may correspond to a processor with associated physical memory. The node may alternatively correspond to a processor with shared memory and/or resources. Further, software instructions for performing one or more embodiments of input deck migration for simulators may be stored on a computer readable medium such as a compact disc (CD), a diskette, a tape, or any other computer readable storage device.

This description is intended for purposes of illustration and should not be construed in a limiting sense. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The scope of input deck migrators for simulators should be determined by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method for performing a field operation on a field, comprising:

collecting field data;

preparing an input deck based on the field data;

performing a first simulation of the field operation based on the input deck using a first simulator;

migrating the input deck from the first simulator to a second simulator by:

parsing the input deck to generate a set of keywords describing a simulation model in the first simulator;

deciphering the simulation model described in the input deck through reverse engineering of the set of keywords;

extracting data from the simulation model subsequent to the reverse engineering to generate interpreted data and formatting the interpreted data for use as the input to the second simulator;

performing a second simulation of the field operation in the second simulator based on the field data derived from the input deck to generate a simulation result; and displaying the simulation results using a display monitor.

2. The method of claim 1, further comprising performing the field operation based on the simulation result.

3. The method of claim 1, wherein deciphering the simulation model through reverse engineering comprises:

analyzing the set of keywords to build a timeline for data on the input deck;

analyzing the set of keywords to identify simulation objects on the input deck;

searching the input deck for references to the simulation objects;

placing the references to the simulation objects on the timeline;

creating effective models corresponding to simulation objects based on the references placed on the timeline;

creating an object graph of the effective models; and analyzing the object graph to verify that the object graph is complete.

4. The method of claim 3, wherein extracting data from the simulation model to generate the interpreted data comprises:

extracting data from the object graph to generate the interpreted data; and storing the interpreted data in a simulator-independent simulation model.

5. A non-transitory computer readable medium, embodying instructions executable by a computer to perform a method for performing a field operation on a field, the instructions comprising functionality for:

obtaining an input deck of a first simulator, the input deck being prepared based on field data for performing a simulation of the field operation using the first simulator;

migrating the input deck from the first simulator to generate input for a second simulator by:

parsing the input deck to generate a set of keywords describing a simulation model in the first simulator;

deciphering the simulation model described in the input deck through reverse engineering of the set of keywords;

extracting data from the simulation model subsequent to the reverse engineering to generate interpreted data and formatting the interpreted data for use as the input to the second simulator, wherein the second simulator is configured to simulate the field operation based on the input to generate a simulation result; and storing the simulation result in a repository.

6. The non-transitory computer readable medium of claim 5, wherein the instructions when executed by the processor further comprising functionalities for performing the field operation based on the simulation result.

7. The non-transitory computer readable medium of claim 5, wherein deciphering the simulation model through reverse engineering comprises:

analyzing the set of keywords to build a timeline for data on the input deck;

analyzing the set of keywords to identify simulation objects on the input deck;

searching the input deck for references to the simulation objects;

placing the references to the simulation objects on the timeline;

creating effective models corresponding to simulation objects based on the references placed on the timeline;

creating an object graph of the effective models; and analyzing the object graph to verify that the object graph is complete.

8. The non-transitory computer readable medium of claim 7, wherein extracting data from the simulation model to generate the interpreted data comprises:

extracting data from the object graph to generate the interpreted data; and storing the interpreted data in a simulator-independent simulation model.

9. A field system for performing a field operation of a field, comprising:

a repository for storing an input deck prepared based on field data;

a first simulator configured to perform a simulation of the field operation based on the field data received from the input deck; and a migrator configured to migrate the input deck used by the first simulator to generate input for a second simulator by:

parsing the input deck to generate a set of keywords describing a simulation model in the first simulator;

deciphering the simulation model described in the input deck through reverse engineering of the set of keywords;

extracting data from the simulation model subsequent to the reverse engineering to generate interpreted data and formatting the interpreted data for use as the input to the second simulator, wherein the second simulator is configured to simulate the field operation based on the input to generate a simulation result.

10. The field system of claim 9, further comprising a display monitor for displaying the simulation result.

11. The field system of claim 9, further comprising a field application operatively coupled with the second simulator and configured to perform the field operation based on the simulation result.

12. The field system of claim 9, further comprising a surface unit for collecting the field data, wherein the surface unit is operatively coupled to the input deck.

13. The field system of claim 12, further comprising a controller operatively coupled to the surface unit, wherein the controller is configured to actuate one or more mechanisms at the field.

14. The field system of claim 9, wherein the migrator comprises a keyword reader in communication with the input deck, wherein the keyword reader is configured to parse the input deck to generate the set of keywords.

15. The field system of claim 14, wherein the keyword reader further comprises a keyword descriptor and a keyword parser, wherein the keyword parser is configured to parse the input deck to generate the set of keywords using the keyword descriptor.

16. The field system of claim 15, wherein the migrator further comprises a reverse engineering logic to decipher the simulation model described in the input deck by analyzing the set of keywords generated by the keyword reader.

17. The field system of claim 16, wherein the migrator further comprises a simulator-independent simulation model in communication with the reverse engineering logic and a data exporter in communication with at least one of the first simulator and the second simulator, wherein the data exporter is configured to extract data from the simulation-independent simulation model to generate interpreted data.

* * * * *